US006213417B1

(12) United States Patent
Schwelling

(10) Patent No.: US 6,213,417 B1
(45) Date of Patent: Apr. 10, 2001

(54) DEVICE FOR THE DELAYED DRIVE DISCONNECTION OF CUTTING MECHANISMS OF PAPER SHREDDERS

(76) Inventor: Hermann Schwelling, 88682, Salem (DE)

( * ) Notice: Subject to any disclaimer, the term of this patent is extended or adjusted under 35 U.S.C. 154(b) by 0 days.

(21) Appl. No.: 09/215,994

(22) Filed: Dec. 18, 1998

(30) Foreign Application Priority Data

Dec. 23, 1997 (DE) ..... 197 57 766

(51) Int. Cl.[7] ..... B02C 25/00
(52) U.S. Cl. ..... 241/36; 241/100; 241/236
(58) Field of Search ..... 241/36, 37.5, 100, 241/236, 34

(56) References Cited

U.S. PATENT DOCUMENTS 5,662,280 * 9/1997 Nishio et al. ..... 241/36
5,775,605 * 7/1998 Tsai ..... 241/36

* cited by examiner

*Primary Examiner*—Mark Rosenbaum
(74) *Attorney, Agent, or Firm*—Friedrich Kueffner

(57) ABSTRACT

A device for the delayed disconnection or switching-off of the drive of cutting mechanisms of paper shredders, wherein the switching-on process of the cutting mechanisms is automatically triggered predominantly by the insertion of the materials to be shredded into the feed shaft. At least one of the gear stages between the drive motor and the pair of cutting rollers is provided with a spiral or helical gear unit, wherein at least one of the gear wheels of the gear unit is mounted so as to be axially movable in the direction of its axis, and wherein a switching element or limit switch connected to the motor control is arranged in the range of the axial distance of movement of the at least one gear wheel.

6 Claims, 1 Drawing Sheet

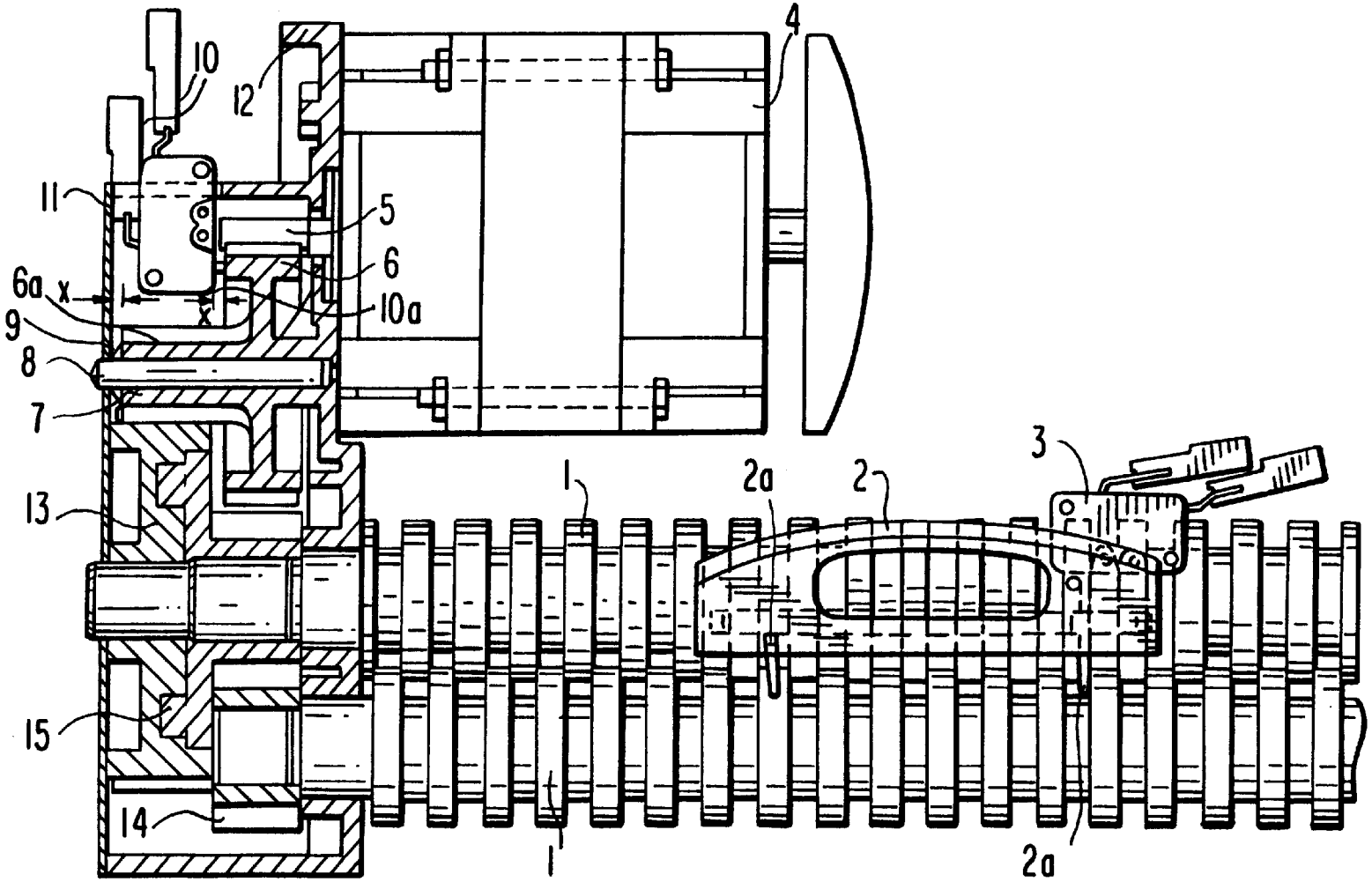
1
1
2
2a
2a
3
4
5
6
6a
7
8
9
10
10a
11
12
13
14
15
x
x

DEVICE FOR THE DELAYED DRIVE DISCONNECTION OF CUTTING MECHANISMS OF PAPER SHREDDERS

BACKGROUND OF THE INVENTION

1. Field of the Invention

The present invention relates to a device for the delayed disconnection or switching-off of the drive of cutting mechanisms of paper shredders, wherein the switching-on process of the cutting mechanisms is automatically triggered predominantly by the insertion of the materials to be shredded into the feed shaft.

2. Description of the Related Art

In cutting mechanisms of paper shredders, the delayed disconnection of the drive has the purpose of ensuring that the drive always stops only after the cutting mechanism has been cleared or cleaned, i.e., the paper particles, dust resulting from cutting, etc., have left the cutting mechanism, and primarily of ensuring that the respective document has been completely destroyed or shredded.

In order to achieve this, electronically acting components have already become known in actual practice which are provided for the drive control. However, these components have the specific disadvantage that they are relatively expensive.

Also known in the art are pneumatic devices which operate with an air cylinder and delay valve. In addition to the disadvantage of a hard switching-on process, this type of construction also has the specific disadvantage that it is relatively expensive and that the many fine mechanical structural elements are susceptible to trouble. In addition, the electronic and pneumatic delay elements which have thus far become known in the art have the principal disadvantage that the duration of the after-running time of the cutting mechanism must be preadjusted empirically; however, since it is generally known that depending on the type of paper, the "self-cleaning" time of the cutting mechanisms varies widely and takes particularly long in the case of very thin paper, the systems which have become known in the art always constitute a compromise solution which is not very effective.

SUMMARY OF THE INVENTION

Therefore, it is the primary object of the present invention to make it possible to influence with simple measures the duration of the after-running time in cutting mechanisms of paper shredders merely in dependence on the load and automatically without having to preadjust any values; in other words, the drive is to be stopped automatically only when the cutting rollers have actually completely run free, i.e., are cleaned.

In accordance with the present invention, the above-described object is met in a surprisingly simple manner by providing at least one of the gear stages between the drive motor and the pair of cutting rollers with a spiral or helical gear unit, wherein at least one of the gear wheels of the gear unit is mounted so as to be axially movable in the direction of its axis, and wherein a switching element or limit switch connected to the motor control is arranged in the range of the axial distance of movement of the at least one gear wheel.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic top view of a paper shredder cutting mechanism with switches and drive elements.

DESCRIPTION OF THE PREFERRED EMBODIMENTS

The drawing shows a cutting mechanism 1 whose roller drive motor 4 is automatically switched on in the conventional manner when a sheet of paper or the like is inserted into the cutting gap between the rollers in a purely mechanical manner by means of the cams 2*a* of the switching rocker 2 which interacts with the limit switch 3.

In accordance with the present invention, the first gear stage following the drive motor 4 and composed of the drive pinion 5 and the driven wheel 6 has a helical or spiral gearing 6*a* and the hub 7 of the driven wheel 6 is axially movably mounted on its axis 8. Consequently, when a load is applied to the cutting mechanism 1, the wheels 6, 7 are subjected to an axial force component and carry out a stroke "x" in the direction toward the outer bearing plate 11.

In accordance with the second principal feature of the present invention, a switching element or limit switch 10, 10*a* connected to the motor control is arranged within the range of the axial stroke "x", wherein the limit switch 10, 10*a* is arranged as seen in axial direction immediately next to the end face of the drive pinion 5 and its switching pin 10*a* faces in the direction toward the sides of the teeth of the driven wheel 6 of the first gear stage. As a result of this arrangement and configuration, the second end switch 10 connected to the motor control remains active as long as the cutting mechanism is under load and switches off only when the load has disappeared, i.e., the cut particles or the like have been cleared out of the cutting mechanism.

Another important aspect with respect to the operation of the device is the arrangement of a spring 9 as a restoring element for the driven wheel 6, 6*a*, wherein the restoring element advantageously is constructed as a compression spring 9 and is arranged at the end of the axis 8 between the wheel hub 7 and the bearing plate 11; however, any other type and arrangement of an elastic restoring element which becomes effective when the load acting on the cutting mechanism disappears is conceivable.

Independently of the specific illustration in the drawing, the significant technical teaching of the present invention resides in that at least one of the gear stages 5, 6 and/or 13, 14 between the drive motor 4 and the pair of cutting rollers 1 is provided with a helical or spiral gear unit 6*a* and at least one of the gear wheels 6, 7 and/or 13, 14 is mounted axially movable by a stroke x on its axis, for example, axis 8, and a switching element, preferably an end switch 10 connected to the motor control is arranged within the range of the axial stroke x.

While specific embodiments of the invention have been shown and described in detail to illustrate the inventive principles, it will be understood that the invention may be embodied otherwise without departing from such principles.

I claim:

1. A cutting mechanism of a paper shredder in combination with a device for a delayed disconnection of a drive of the cutting mechanism, the cutting mechanism having a feed shaft, a drive motor and a pair of cutting rollers driven by the drive motor, the device comprising means for automatically triggering a switching-on process of the cutting mechanism when materials to be shredded are introduced into the feed shaft, at least one gear stage between the drive motor and the pair of cutting rollers comprising a spiral gear unit, wherein at least one gear wheel of the spiral gear unit is mounted so as to be axially movable on an axis thereof, and wherein a switching element connected to a motor control is arranged within a range of axial movement of the at least one gear wheel.

2. The mechanism according to claim 1, wherein the switching element is a limit switch.

3. The mechanism according to claim 2, wherein the gear unit is comprised of a drive pinion and the at least one gear wheel, wherein the limit switch is arranged immediately next to an end face of the drive pinion and wherein the limit switch has a switching pin facing in a direction toward tooth sides of the at least one gear wheel.

4. The mechanism according to claim 1, further comprising a restoring element configured to act on the at least one gear wheel.

5. The mechanism according to claim 4, wherein the restoring element is a spring.

6. The mechanism according to claim 5, wherein the restoring element is a compression spring and is mounted at an end of the axis between a hub of the at least one gear wheel and a bearing plate.

* * * * *